US005735755A

United States Patent [19]

Kobayashi

[11] Patent Number: 5,735,755

[45] **Date of Patent: *Apr. 7, 1998**

[54] IRON-TYPE GOLF CLUB HEAD

[75] Inventor: Kenji Kobayashi, Tsubame, Japan

[73] Assignee: Kabushiki Kaisha Endo Seisakusho, Niigata-Ken, Japan

[ * ] Notice: The term of this patent shall not extend beyond the expiration date of Pat. No. 5,601,501.

[21] Appl. No.: 661,607

[22] Filed: Jun. 11, 1996

[30] Foreign Application Priority Data

Apr. 18, 1996 [JP] Japan ..... 8-096959

[51] Int. Cl.[6] ..... A63B 53/04

[52] U.S. Cl. ..... 473/342; 473/349; 473/350; 473/331

[58] Field of Search ..... 473/324, 325, 473/329, 332, 334, 342, 349, 350, 331

[56] References Cited

U.S. PATENT DOCUMENTS

| | | | |
|---|---|---|---|
| 1,756,219 | 4/1930 | Spiker | 473/251 |
| 3,847,399 | 11/1974 | Raymont . | |
| 5,090,702 | 2/1992 | Viste . | |
| 5,255,918 | 10/1993 | Anderson | 473/342 |
| 5,601,501 | 2/1997 | Kobayashi | 473/350 |
| 5,611,742 | 3/1997 | Kobayashi | 473/345 |

FOREIGN PATENT DOCUMENTS

| | | |
|---|---|---|
| 60-177867 | 11/1985 | Japan . |
| 2-241469 | 9/1990 | Japan . |
| 6-31766 | 4/1994 | Japan . |

*Primary Examiner*—Sebastiano Passaniti
*Attorney, Agent, or Firm*—Quarles & Brady

[57] ABSTRACT

An iron-type golf club head for realizing free weight distribution of a head with a face made thinner. A flatted surface 1A of a head body 1 is formed with a plurality of honeycomb-shaped cavities by forging. Owing to the advantages associated with the forging and the honeycomb shape, a face 4 can be made thinner, while avoiding the deterioration of the strength of the face 4. Thus, a surplus weight thus obtained can be distributed to other parts of the head body 1.

10 Claims, 4 Drawing Sheets

FIG. 1
FIG. 1a
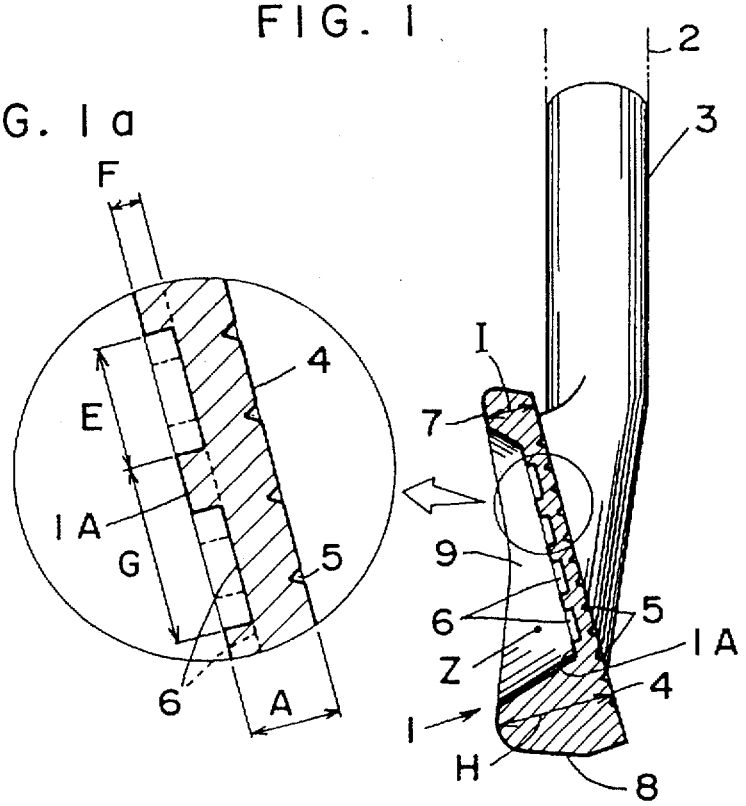
FIG. 2
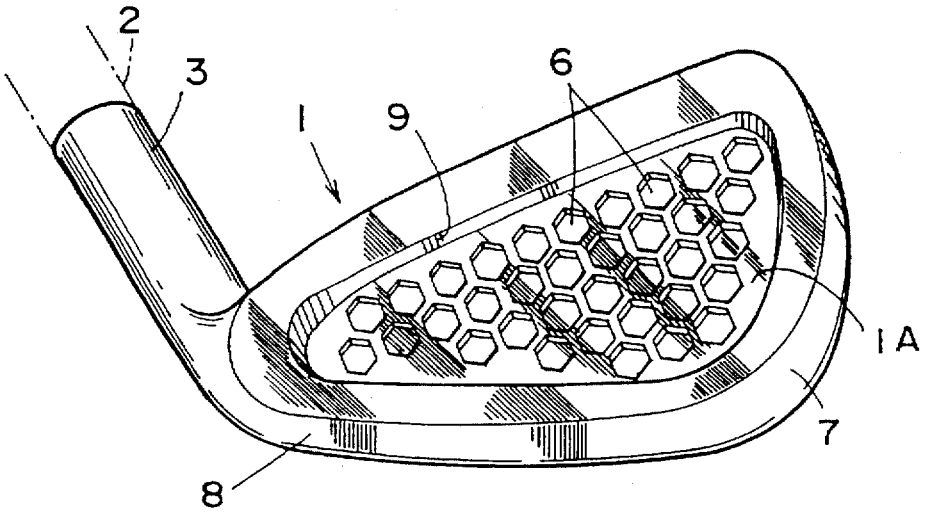

IRON-TYPE GOLF CLUB HEAD

BACKGROUND OF THE INVENTION (a) Field of the Invention

The present invention relates to a metallic iron-type golf club head such as an iron, sand wedge or pitching golf club head.

(b) Description of Prior Art

For this kind of golf club head, there is proposed a golf club head disclosed in Japanese U.M.Appln Laid-Open No.60-177867, which discloses a golf club head having multiple cavities at its back. The prior golf club head aimed at decreasing air resistance when swinging the same by forming the multiple cavities at the back of the head body which had been conventionally formed smooth. Further, there is also proposed another golf club head disclosed in Japanese Patent Appln Laid-Open No.2-241469, which discloses in its FIG. 1 a wood-type golf club head having small cavities formed along a peripheral portion of the head body by cutting process. According to the latter prior golf club head, the said small cavities could enhance a sense of beauty also. In addition, U.S. Pat. No. 3,847,399 proposed a honeycomb-shaped structure behind the face, while U.S. Pat. No. 5,090,702 proposed a ball-striking face provided with external grooves and an internal face provided with internal grooves.

However, according to the above conventional golf club heads, the formed cavities or grooves would cause a part of the face to become thinner, resulting in degraded strength thereof. To eliminate the problem, there is proposed another golf club head in Japanese utility Model Appln Laid-Open No.6-31766, wherein a golf club head is manufactured by casting, having reinforcing ribs behind a face formed with score lines, each reinforcing rib having greater depth and width than each groove of the score lines with the former being aligned to the latter with respect to position and direction, thereby realizing a sufficient strength withstanding an impact when swinging as well as an improved flow of casting when manufacturing the same.

Whereas, it is widely recognized that for enlargement of so-called sweet area, an iron-type golf club heads, should have an elongated distance between a face and the CG of a head body, and/or, should have the weight distribution dispersed toward the periphery thereof by thickening a peripheral edge of the face. However, according to the prior golf club heads, the faces must be formed to a preset thickness because of requirement for the strength at the time of striking balls, therefore, a predetermined weight would be inevitably required to ensure the thickness of the face. As a result, there has been a problem such that a golf club head can not be formed thinner as you like.

SUMMARY OF THE INVENTION

To eliminate the above-mentioned problems, it is, therefore, a main object of the present invention to provide a metallic iron-type golf club head, of which the face can be optionally formed when the face is formed thinner.

According to a major feature of the present invention, there is provided an iron-type golf club head comprising a metallic head body having a shaft attaching portion at one side and a face at its front side, said face being formed on its rear surface with a plurality of honeycomb-shaped cavites.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 1 is a section showing a first embodiment of the invention, while FIG. 1*a* is a partially enlarged section of FIG. 1.

FIG. 2 is a rear view showing a first embodiment of the invention.

DETAILED DESCRIPTION OF THE PREFERRED EMBODIMENTS

Figure 3:
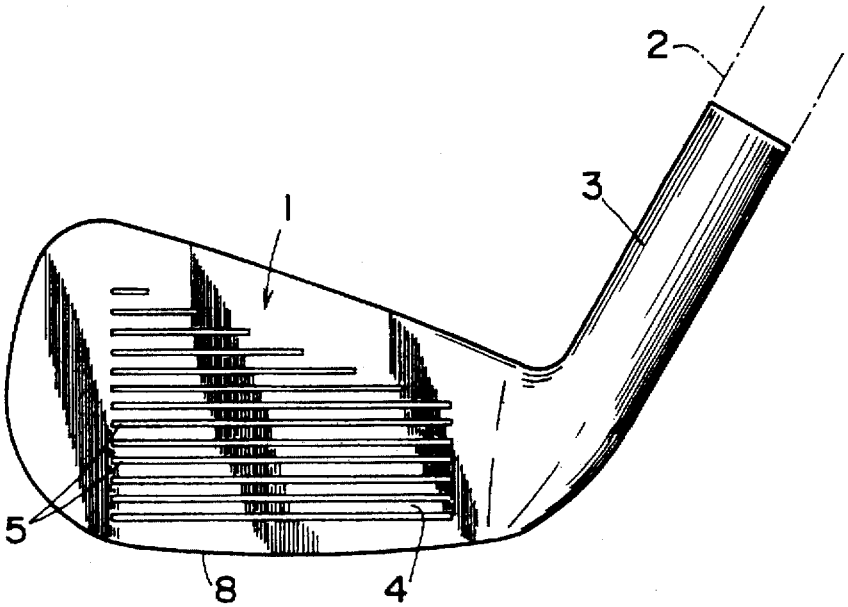
FIG. 3 is a front view showing a first embodiment of the invention.

Hereinafter is described a first embodiment of a golf club head of the invention with reference to FIGS. 1 to 4, in which reference numeral 1 designates a metallic head body. The head body 1 has a hosel 3 for mounting a shaft 2 thereto, and a face 4 for striking balls at its front. The face 4 has a thickness A of 1.0 to 3.5 mm, preferably 2.5 mm, having groove-like score lines 5 formed thereon.

A rear surface of the head body 1 is formed with a flatted surface 1A opposite to the face 4, having plural cavities 6 formed rather dense, while a peripheral edge of the flatted surface 1A is formed with an annular projection 7, defining a large cavity 9 and constructing a sole 8 at its lower part.

Cavities 6 within said large cavity 9 are each of an equilateral hexagon configuration congruent to each other, as seen from its front side, disposed in a honeycomb-like manner as a whole. Additionally, each cavity 6 has a width E defined as a length of its diagonal line ranging from 3 to 8 mm, preferably 5 to 6 mm, a depth F from 0.2 to 1.7 mm, preferably 0.7 to 1.2 mm and an interval G taken in a file thereof of 3 to 10 mm, preferably 5 to 7 mm.

In a preferred form of the invention, the cavities 6 totaled preferably make up at least 70% of the flatted surface 1A.

Next, a method for manufacturing the above-structured golf club head will be described.

Figure 4:
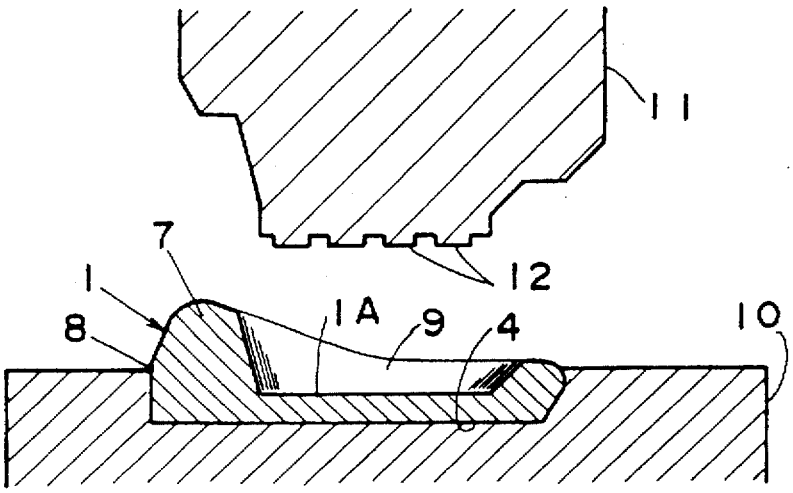
FIG. 4 is an explanatory section illustrating a manufacturing process of a golf club head of a first embodiment of the invention.

For example, as shown in FIG. 4, the face 4 and the flatted surface 1A are each formed in the head 1 in advance by means of hot or cold forging of carbon steels for machine structural use such as JIS standard S20C or S25C or any suitable metal material such as pure titanium, titanium alloy or beryllium copper alloy. Specifically, the above steel products should undergo annealing process after the hot forging. Next, the head body 1 is placed on a lower die 10 of the forging device, while a lower surface of an upper die 11 is formed with convex portions 12 to form the plural cavities 6. Then, the upper die 11 is pressed onto the flatted portion 1A to simultaneously form the plural cavities 6 by cold forging. For the steel products, such cavities 6 may be formed by hot forging. After thus forming the cavities 6, the score lines 5 are formed, and then, the surface is polished to a final product.

According to a first embodiment of the invention, the flatted surface 1A of the head body 1 is formed with the plural cavities 6 by forging, whereby the face 4 is strengthened, thus making the thickness A of the face 4 thin. Further, the plural cavities 6 are honeycomb-shaped, the thickness A of the face 4 can be made thinner, while avoiding the deterioration of the strength thereof. Consequently, the thickness A can be made thinner to 1.0 to 3.5 mm thickness, whereby you can distribute a surplus weight thus obtained, for example, to the sole 8 in order to enlarge the thickness H thereof, thus elongating the distance between the center of gravity Z of the head body 1 and the face 4 to enlarge a sweet area, or you can also enlarge a sweet area by distributing the surplus weight to the annular projection 7 to make the thickness I greater. In addition, the above honeycomb-shaped cavities 6 can also enhance a beauty of an appearance of the head body 1.

Table 1 shown below indicates the contrast between the results of the tensile tests wherein the plates formed with the equivalents to the cavities 6 (sample Nos.3 and 4) were compared to the plates without the same (sample Nos.1 and 2). Further, the Table 1 also shows the contrast between the results of the bending tests wherein the plate formed with the equivalents to the cavities 6 (sample No.2) was compared to the plate without the same (sample No.1).

An iron-type golf club head of a second embodiment of the invention comprises a head body 21 made of, for example, beryllium copper alloy (the specific gravity: approx.8.2) having a window aperture 22 provided in a face-equivalent portion of said head body 21; a face member 23 having a face 23A at its front surface, which is made of carbon steel for machine structural use (the specific gravity: approx.7.8), pure titanium or titanium alloy, said face member being fitted into said window aperture 22.

The face member 23 is formed by hot forging, and then its rear surface 24 is formed with honeycomb-shaped cavities 25.

According to a second embodiment of the invention, the caivites 25 are formed in advance on the rear surface 24 of the face member 23 to be fitted into the window aperture 22 of the head body 21, whereby the face member 23 is strengthened, thus enabling it to make the thickness of the face member 23 thin. Further, the plural cavities 25 are honeycomb-shaped, the thickness of the face member 23 can be made thinner, while avoiding the deterioration of the

TABLE 1

Tensile Test

| | | | test piece | | | tensile | | yield | | | |
|---|---|---|---|---|---|---|---|---|---|---|---|
| No. | sample No. | material | dimension mm | cross-sectional area $mm^2$ | original gauge length mm | load N | tensile strength $N/mm^2$ | load N | yield point $N/mm^2$ | yield elongation % | reduction of area % |
| 1 | 1 | S20C | 5.8 × 24.5 | 142.1 | 49.9 | 75096 | 528.5 | 52920 | 372.4 | 34.1 | — |
| 2 | 2 | " | 6.0 × 24.3 | 145.8 | 49.6 | 73619 | 504.9 | 54517 | 374.0 | 35.5 | — |
| 3 | 3 | " | 5.8 × 24.5 | 142.1 | 50.1 | 90866 | 639.5 | 63337 | 445.7 | 2.0 | — |
| 4 | 4 | " | 5.8 × 24.4 | 141.5 | 50.0 | 91457 | 646.3 | 62475 | 441.5 | 2.6 | — |

Bending Test

| | | | test piece | | | | | result crack on the outer | |
|---|---|---|---|---|---|---|---|---|---|
| No. | sample No. | material | cross-sectional dimension mm | length mm | angle of bend (deg.) | inside radius mm | bearing distance mm | periphery of the bent piece | remark |
| 1 | 1 | S20C | 5.9 × 20.0 | 149.8 | 180 | 12 | 36 | none | deformation - starting load note1) : 4288N |
| 2 | 2 | " | 5.9 × 19.6 | 151.0 | 180 | " | " | fractured | deformation - starting load note1) : 6370N |

notes
note1) deformation-starting load was assumed to be a proportional limit in a load-elongation diagram.

According to the result of the tensile test in Table 1, the average tensile strength of the plates with the cavities (sample Nos.3 and 4) was 642.9N/mm, while that of the plates without the cavities (sample Nos.1 and 2) 516.7N/mm, which indicated that the forming of the cavities could increase the tensile strength by 24.4%. Whilst, according to the result of the bending test in Table 1, the deformation-starting load of the plate with the cavities (sample No.2) was 6,370N, while that of the plate without the cavities (sample No.1) 4,288N, which indicated that the forming of the cavities could increase the bending strength by 48.5%. Such improvement of the strength presumably results from the enhanced toughness and durability of the material associated with the formation of even and fine tissues and grain flows by forming the cavities by means of forging.

Figure 5:
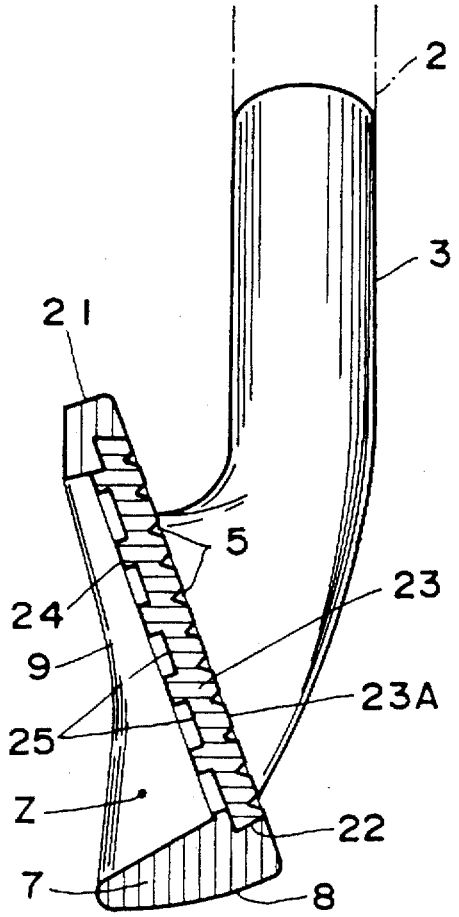
FIG. 5 is a section showing a second embodiment of the invention.
Figure 6:
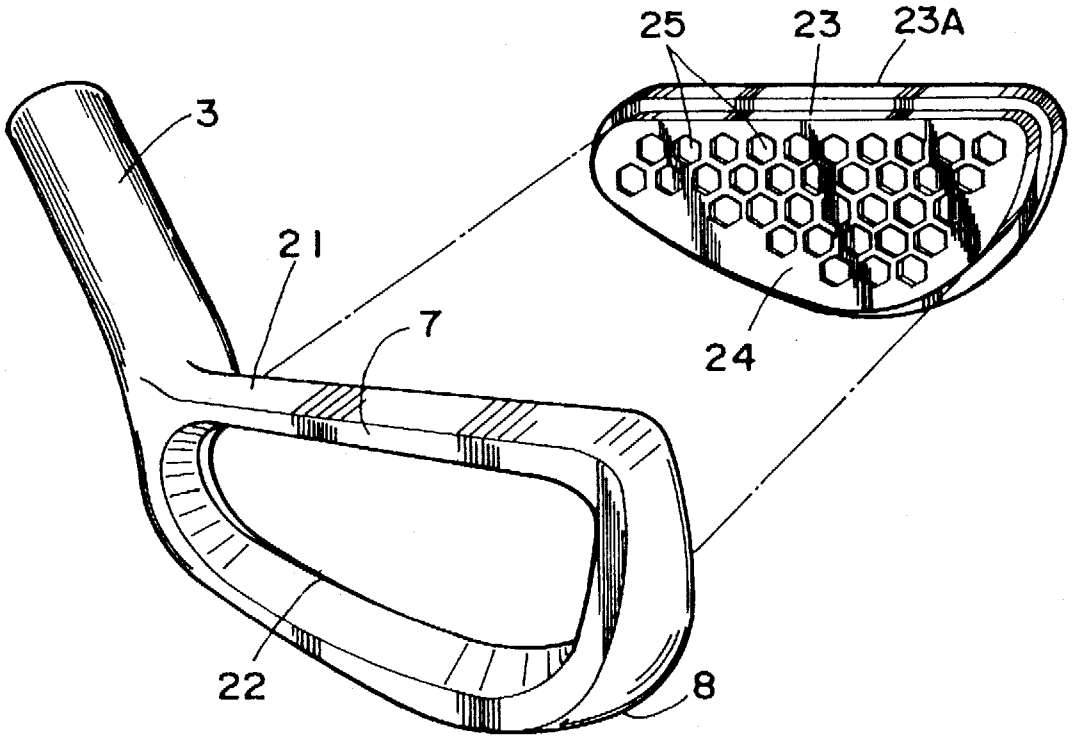
FIG. 6 is an exploded perspective view showing a second embodiment of the invention.

In FIGS. 5 to 6 showing a second embodiment of the invention, the same portions as those described in a first embodiment are designated as common reference numerals, and their repeated detailed descriptions will be omitted.

strength thereof. Accordingly, you can distribute a surplus weight thus obtained, for example, to the sole 8 in order to enlarge a sweet area. Further, as the head body 21 is made of the material of the different specific gravity than that of the face member 23, the distance between the center of gravity Z of the head body 21 and the face 23A can be elongated, thereby further enlarging a sweet area. In addition, the above honeycomb-shaped cavities 25 can also enhance a beauty of an appearance of the head body 21.

Incidentally, the present invention should not be limited to the foregoing embodiments, but may modified within a technical scope of the invention.

What is claimed:

1. An iron-type golf club head having a metallic head body with a shaft attaching portion at one side and a face at a front side, comprising:

a plurality of cavities formed on a rear surface of said face by forging, said cavities being each congruent hexagon-shaped, disposed at predetermined intervals in a plurality of ranks.

2. An iron-type golf club head according to claim 1, wherein said face is formed to a 1.0 to 3.5 mm thickness.

3. An iron-type golf club head according to claim 1, wherein the honeycomb-shaped cavities totaled make up at least 70% of the rear surface of the face.

4. An iron-type golf club head according to claim 1, wherein said head body is made of a metal selected from one of the group consisting of carbon steel, pure titanium, titanium alloy and beryllium copper alloy.

5. An iron-type golf club head according to claim 1, wherein each of said intervals is defined as a rib of a rectangular section.

6. An iron-type golf club head having a metallic head body with a shaft attaching portion at one side and a face at a front side comprising:

a head body having a window aperture provided in a face-equivalent portion of said head body;

a face member having said face at a front surface, said face member being fitted into said window aperture;

a plurality of cavities formed on a rear surface of said face member by forging, said cavities being disposed at predetermined intervals in a plurality of ranks.

7. An iron-type golf club head according to claim 3, wherein said face is formed to a 1.0 to 3.5 mm thickness.

8. An iron-type golf club head according to claim 6, wherein the honeycomb-shaped cavities totaled make up at least 70% of the rear surface of the face member.

9. An iron-type golf club head according to claim 3, wherein said head body is made of beryllium copper alloy, while said face member is made of a metal selected from the group consisting of carbon steel, pure titanium and titanium alloy.

10. An iron-type golf club head according to claim 6, wherein each of said intervals is defined as a rib of a rectangular section.

* * * * *